US007152658B2

(12) United States Patent
Hartmann et al.

(10) Patent No.: US 7,152,658 B2
(45) Date of Patent: Dec. 26, 2006

(54) PROCESS AND APPARATUS FOR CASTING METALLIC MATERIALS

(75) Inventors: Mark Hartmann, Kempten (DE); Andreas Lohmüller, Fürth (DE); Sabine Pahlke, Nümberg (DE); Bernd Tröger, Nümberg (DE)

(73) Assignee: Demag Ergotech GmbH, Schwaig (DE)

( * ) Notice: Subject to any disclaimer, the term of this patent is extended or adjusted under 35 U.S.C. 154(b) by 136 days.

(21) Appl. No.: 10/636,912

(22) Filed: Aug. 7, 2003

(65) Prior Publication Data

US 2004/0079509 A1 Apr. 29, 2004

(30) Foreign Application Priority Data

Aug. 10, 2002 (DE) ..... 102 36 794

(51) Int. Cl.
*B22D 17/08* (2006.01)

(52) U.S. Cl. ..... 164/113; 164/900

(58) Field of Classification Search ..... 164/113, 164/900, 312
See application file for complete search history.

(56) References Cited

U.S. PATENT DOCUMENTS 4,694,882 A 9/1987 Busk
6,478,075 B1 * 11/2002 Shibata et al. ..... 164/113
6,564,854 B1 * 5/2003 Sakate et al. ..... 164/113
6,655,445 B1 * 12/2003 Kono ..... 164/113
6,745,818 B1 * 6/2004 Fan et al. ..... 164/113
6,840,302 B1 * 1/2005 Tanaka et al. ..... 164/113
6,860,314 B1 * 3/2005 Koide et al. ..... 164/113

FOREIGN PATENT DOCUMENTS

| | | |
|---|---|---|
| DE | 36 26 125 | 2/1987 |
| DE | 199 43 096 | 3/2001 |
| DE | 100 43 717 | 3/2002 |
| EP | 1 004 374 | 5/2000 |
| WO | WO 00/41831 | 7/2000 |

OTHER PUBLICATIONS

Müller-Späth et al.: "Inovative Giesstechnologie für die Zukunft: Thixogiessen und Magnesium-Druckguss", in: Giesserei-Erfahrungsaustausch, Oct. 1998.
Gies et al.: Reliable Heating Processes for Thixomaterial, in: Giesserei-Praxis Special 2001.

* cited by examiner

*Primary Examiner*—Len Tran
(74) *Attorney, Agent, or Firm*—Henry M. Feiereisen

(57) ABSTRACT

A process and an apparatus for continuous casting of metallic materials in a semi-solid state is disclosed. A solid metallic material is processed by heating the material in a first container with an inductive heater to a temperature above the solidus temperature. The processed metallic material is then transported to a storage container, from there to an injection unit and subsequently to a casting tool.

9 Claims, 4 Drawing Sheets

PROCESS AND APPARATUS FOR CASTING METALLIC MATERIALS

CROSS-REFERENCES TO RELATED APPLICATIONS

This application claims the priority of German Patent Application, Ser. No. 102 36 794.9, filed Aug. 10, 2002, pursuant to 35 U.S.C. 119(a)–(d), the disclosure of which is incorporated herein by reference.

BACKGROUND OF THE INVENTION

The invention relates to a process and an apparatus for casting metallic materials, and more particularly to a process and an apparatus for casting metallic materials which are in a semi-solid state.

U.S. Pat. No. 4,694,882 describes the use of a semi-solid metallic material for casting, employing an extruder for processing the metallic material in semi-solid form. The process described therein has a number of disadvantages, in particular relating to the use of a processing assembly in form of an extruder with a thrust screw.

WO00/41831 discloses a different approach whereby semi-solid metallic material is processed using a so-called warm-chamber-casting process. This published application describes using a conventional heating chamber for transforming the solid metallic material into a semi-solid state. An injection unit which operates like a sump pump is immersed in the heating chamber. The temperature of the semi-solid material is then equalized by the surrounding heated metallic material. However, this apparatus enables only batch operation and not continuous operation.

It would therefore be desirable and advantageous to provide an improved apparatus for casting metallic materials, which obviates prior art shortcomings and enables continuous operation.

SUMMARY OF THE INVENTION

According to one aspect of the invention, a process for casting metallic materials includes the steps of processing a solid metallic starting material disposed in a first container by heating the material with an inductive heating device to a temperature above the solidus temperature of the metallic starting material, transporting the processed metallic material to a storage container, transporting the processed metallic material from the storage container to an injection unit; and transporting the processed metallic material from the injection unit to a casting tool.

With this approach, the process can advantageously be carried out continuously, with the storage container operating as a buffer volume. Solid metallic starting material can be fed either continuously or batch-wise to the first container, where it is heated to a temperature above the material's solidus temperature, preferably to a temperature between solidus and liquidus. The processed metallic material is then transported to the storage container, where the material can be either held at the same temperature or its temperature can be varied, depending on the situation dictated by the size and geometry of a component to be manufactured.

The process of the invention and the use of a casting system with a storage container that receives the processed metallic material from the first container, enables a continuous operation of the processing process, so that the first container can be used with maximum efficiency.

The separate injection unit is connected with the storage container via an interruptible flow connection. Forces generated in the system during injection are thereby confined to the injection unit, so that only the injection unit needs to be mechanically sturdy. The ability to interrupt the connection between the injection unit and the storage container prevents backflow of metallic material from the injection unit into the storage container and allows pressure to build up in the injection unit.

The process of the invention obviates the need to integrate several functions in a single highly stressed assembly and does not require large components made of expensive high-temperature material. Expensive materials need only be employed in specific sections subjected to corrosion and wear.

Moreover, regular maintenance and repairs can be performed without cumbersome disassembly of the entire processing and injection assembly.

The casting process according to the invention can be flexibly adapted to different material processing requirements and short cycle times can be achieved through parallel processing during the entire process sequence. The injection unit can also be easily adapted to meet a desired injection performance, for example by suitable selection of the piston size. The design of the injection unit can be matched to the design of other units of the system that performs the process according to the invention.

According to an advantageous feature of the invention, the injection unit can be operated independent of the mode of operation of the processing assembly, i.e., of the first container with the inductive heating device, since the injection process is decoupled by the storage container from the actual processing operation (in the first container).

When an inductive heating device is used for heating the solid metallic starting material, the metallic material is simultaneously stirred through an electromagnetic action which causes forced convection inside the volume of the first container. Accordingly, the materials are thoroughly mixed and a temperature equilibrium is reached more quickly. In addition, a shear effect is produced in the heated volume which prevents and/or counteracts the formation of dendrite structures.

According to an advantageous feature of the process of the invention, a separate inductive device can be employed to produce an additional stirring effect. The inductive heating device can therefore be used to foremost heat the metallic material and produce a temperature equilibrium within the first container. On the other hand, the separate inductive device can be used for stirring and to produce a shear effect so as to intentionally convert any dendrite structures which may form in the volume of the molten metallic material in the first container, into globulite particles.

Alternatively, the metallic material can be heated to a temperature at or above the liquidus temperature. This has the advantage that a microstructure is attained in the produced components which is independent of the structure in the solid metallic starting material. This requires additional energy, since the material mass has to be heated to a temperature above the desired final temperature. However, the final microstructure of the component is then independent of the history of the starting material.

This may not be of concern for certain components, in which case a process can advantageously be used wherein the temperature the first container is only heated to the abovementioned range between solidus and liquidus, which requires less energy and the processing temperature can be reached more quickly. The materials of the apparatus are also under less strain. Moreover, the processed materials have less tendency to oxidize and to include dissolved gases. This temperature profile has the additional advantage that the seals have to meet less stringent requirements due to the lower temperatures.

The processed metallic material is preferably withdrawn at the bottom of the first container, and the withdrawn material preferably passes through a sieve or strainer before being introduced into the storage container. The sieve is preferably placed directly on the container bottom of the first container. In this way, metallic material can be introduced in solid form directly into the first container where it sinks to the bottom due to its greater density as compared to the density of the molten liquid material.

Transfer of the processed metallic material from the first container to the storage container can be achieved by static pressure, whereby the maximum fill level of the storage container should be below the minimal fill level of the first container.

Alternatively, the processed material can also be transferred from the first container to the storage container by using a feed device, in particular a magnetic pump which can operate without moving parts in a feed line disposed between the first container and the storage container.

Alternatively, mechanical feed assemblies can be used, in particular feed screws, gear pumps, eccentric screws, radial piston pumps, rotary pumps and/or centrifugal pumps.

According to another aspect of the invention, an apparatus for casting metallic materials includes a feed unit for feeding a solid metallic material, a first container operatively connected to the feed unit and receiving the solid metallic material from the feed unit, an inductive heating device operatively connected to the first container for heating the solid metallic material to a temperature above the solidus temperature of the metallic material, a storage container operatively connected to the first container and receiving the processed metallic material from the first container and storing the received material, and an injection unit with a piston/cylinder unit. The injection unit is operatively connected to the storage container and receives the stored material from the storage container.

With this apparatus the metallic material can be processed in a very simple manner, eliminating moving parts that contact the processed, i.e. partially molten or entirely molten material. The apparatus therefore requires little maintenance of exposed parts subjected to wear and corrosion.

According to an advantageous feature of the invention, an additional inductive stirring device can be provided in addition to the first inductive heating device. Although the first inductive heating device produces an inherent stirring effect, the additional inductive stirring device produces an additional strong forced convection in the volume of the first container.

To prevent solid material introduced in the first container from sinking to the bottom and entering the storage container via the transfer line before being processed, a sieve or strainer can be arranged at the outlet of the first container.

As mentioned above, the processed metallic material can be transferred by static pressure to the storage container, with the static pressure produced by a level difference between the fill level of the first container and the targeted fill level of the storage container. This imposes certain limitations on the design of the casting system.

Alternatively, in another embodiment of a casting system, a transport device can be provided which transports the processed metallic material from the first container into the storage container. In one embodiment, a magnetic pump can be used as a transport device which eliminates mechanical parts in the casting system. The corresponding components of the magnetic pump can be arranged on the outside of the connecting line to avoid any contact with the processed metallic material.

Alternatively, in particular for reducing the system costs, mechanical pumps can be used which are preferably selected from feed screws, gear pumps, eccentric screws, radial piston pumps, rotary pumps and centrifugal pumps.

The storage device can likewise include a device for stirring the processed metallic material. Electromagnetic stirring can also be employed here, although a mechanical stirring device can also be used. The inductive stirring device advantageously eliminates direct contact between the mechanical parts and the mass of the processed metallic material. The injection unit can be immersed entirely or partially in the volume of the storage container. Temperature control and maintenance work can be facilitated if the injection unit is implemented separate from the storage container.

Total immersion of the injection unit advantageously obviates the need for a separate heating device for the injection unit. Partial immersion of the injection unit affords greater variability and, as mentioned above, simplifies maintenance of the injection assembly which necessarily includes movable parts that come into contact with the processed metallic material.

The processing assembly represented by the first container can be operated continuously or essentially continuously, which may result in a variable fill level of the metallic material in the storage container.

According to an advantageous feature of the invention, the processed metallic material can be transported from the first container to the storage container through a connecting line or feed line that terminates in the storage container below a minimal permissible fill level of the storage container. This avoids contact of the freshly processed metallic material with ambient air and thereby protects the freshly processed metallic material from contact with oxygen in the air. In certain situations, a protective gas atmosphere may be established above the fill level of the storage container as well as in the first container, which can be recommended and may sometimes even be absolutely necessary depending on the metallic material.

The injection unit includes a piston/cylinder arrangement, whereby the cylinder can be oriented essentially vertically or, alternatively, essentially horizontally.

If the storage container and the injection unit are constructed as separate units, a connecting line between the storage container and the injection unit may be provided in form of an interruptible feed channel. A check valve or gate valve can be arranged in the feed channel for the purpose of interrupting the connection between the storage container and the injection unit.

The high temperatures and high injection pressures can pose particular challenges for sealing the injection channel and/or the piston with respect to the cylinder. The end face of the piston can have an opening, and the peripheral surface can have an annular groove adapted to receive a sealing ring. The annular groove and the opening in the end face of the piston can be connected via at least one channel, so that pressure that builds up during the injection process in the injection cylinder extends to the opening and the annular groove and thereby exerts pressure on the sealing ring, pressing the sealing ring against the interior surface of the cylinder. The sealing action of the sealing ring increases proportional to the pressure that builds up at the end face of piston.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
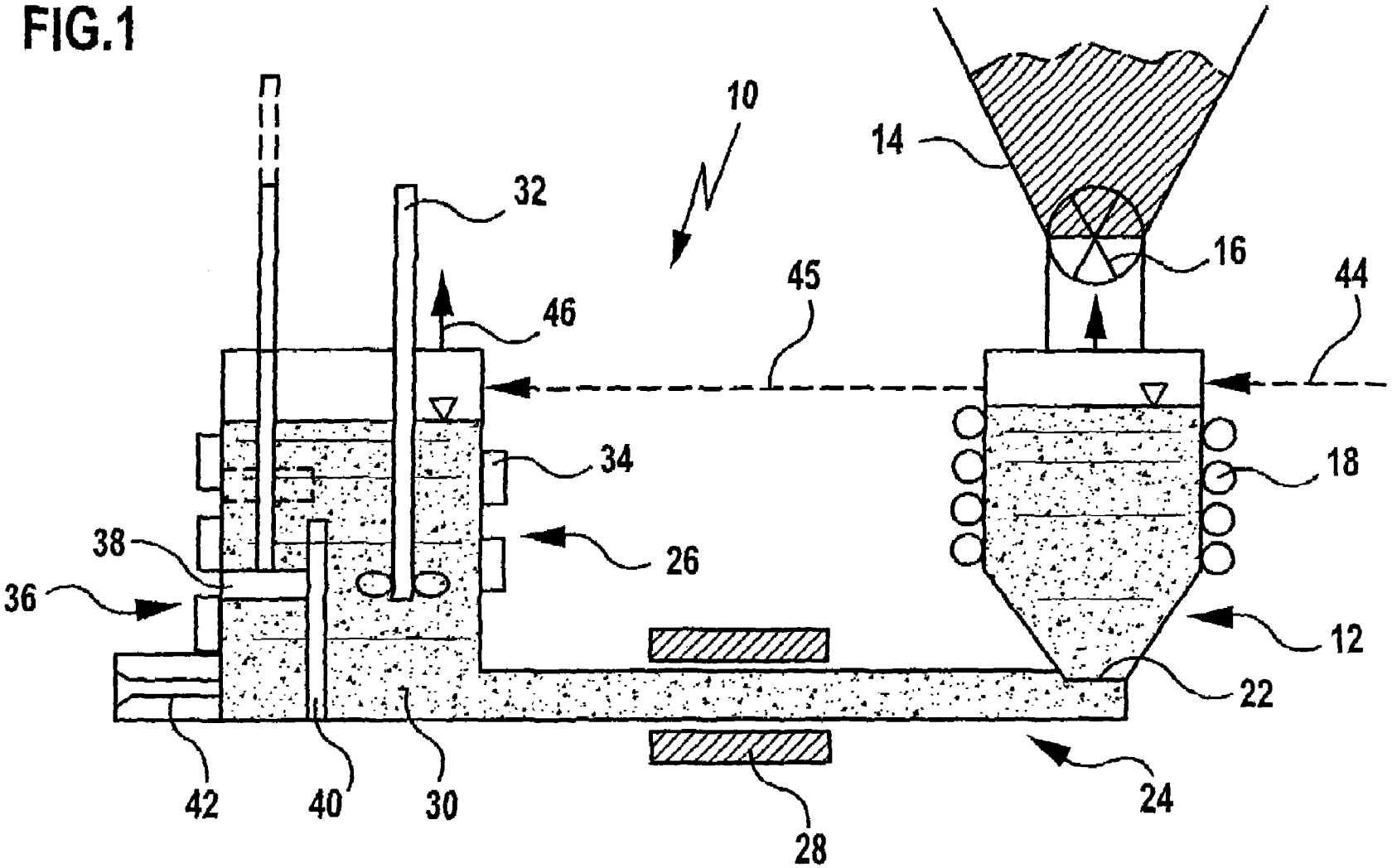
FIG. 1 shows a first embodiment of the casting system according to the invention.

Throughout all the Figures, same or corresponding elements are generally indicated by same reference numerals. These depicted embodiments are to be understood as illustrative of the invention and not as limiting in any way.

Turning now to the drawing, and in particular to FIG. 1, there is shown a casting apparatus 10 according to the invention with a processing assembly in the form of a first container 12 which is fed with solid metallic material, for example in powder, chip or granular form, by a first feed unit 14 via a cellular wheel sluice 16. An inductive heating device 18 is arranged on the exterior circumference of the first container 12. The inductive heating device 18 produces forced convection in the volume 20 of the first container due to an electromagnetic effect acting on the metallic material to be processed. This simultaneously produces a shear effect which prevents the formation of dendrite structures or converts any forming dendrite structures to globulite particles.

An opening which is covered by a sieve or screen (not shown in detail) is provided in or on the bottom 22 of the first container 12. The sieve prevents solid material newly supplied to the container via the cellular wheel sluice 16 from exiting the first container 12. The sieve can, of course, also be placed at a greater height in the first container.

A supply or feed line 24, which transfers the processed metallic material from the volume 20 into a storage container 26, is disposed after the opening in the bottom 22. A magnetic pump 28, which is arranged on the outer circumference of the supply line 24, supports the transfer of the processed metallic material into the storage container 26.

The container 26 stores the processed material and ensures that there is always sufficient quantity of processed material available for the subsequent injection process. A stirring device can also be provided to prevent the formation of dendrite structures while the processed metallic material is residing in the volume 30 of the storage container. The exemplary illustrated embodiment employs a mechanical stirring device 32.

The outer periphery of the storage container is heated by a heating device 34, so that the temperature of the stored processed metallic material is maintained or further conditioned for the injection process.

An injection unit 36 is integrated in the volume of the storage container 26 and includes a piston/cylinder unit with a piston 38 that can move up and down in a vertical direction (indicated by dotted lines).

When the piston 38 is in the uppermost position, the processed metallic material can flow into the cylinder 40. After the cylinder 40 is filled, the piston 38 is pushed downwardly and the processed metallic material is injected through the outlet 42 into a casting tool (not shown).

It will be understood by those skilled in the art that the storage device 26 can include an inductive heating device in lieu of the electric heating device 34, so that the mechanical stirring device 32 may be eliminated due to the stirring effect produced by inductive heating. An inductive stirring device can also be used in combination with the electric heating device 34. The heater power of the electrical heating device 34 can then be reduced, since electromagnetic stirring introduces additional thermal energy into the moving mass of processed metallic material.

The processed metallic materials can be at least partially molten or entirely molten, depending on the temperature control, whereby melting increases their tendency to oxidize. Oxidation can be reduced by keeping the relevant parts of the casting apparatus in a protective gas atmosphere, as indicated by the arrows 44, 45. The protective gas is supplied, as shown in FIG. 1, by first flushing the volume of the first container located above the volume 20 with the protective gas, whereby a portion of the protective gas flows against the feed direction of solid material from the feed unit and/or the cellular wheel sluice 16. This prevents air or oxygen from entering from the direction of the feed unit 14. The protective gas volume above the volume 20 in the container 12 can be connected with the protective gas volume above the volume 30 in the storage container 26 via a line 45. It is recommended that at least a small gas flow rate is maintained and a portion of the introduced protective gas is exhausted via an outlet 46. A pressure control valve can also be provided at the outlet 46, so that the pressure of the processed metallic material above the volume 30 in the storage container 26 is essentially kept constant, independent of the fill level in the storage container 26. The exhausted protective gas can, of course, also be collected and optionally reprocessed and/or reused.

Figure 2A:
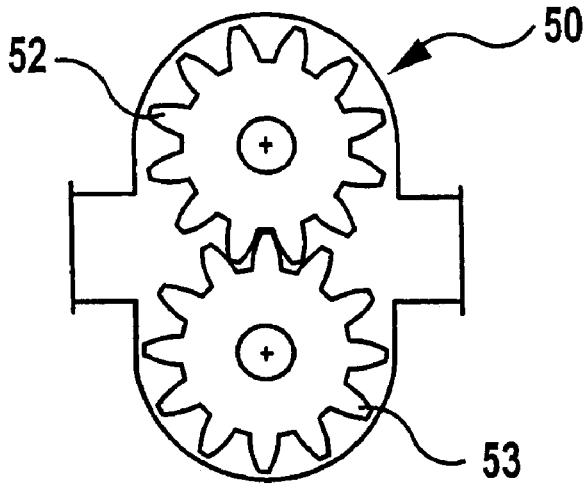
FIGS. 2A–2C show three alternative pumping arrangements for the casting system according to the invention depicted in FIG. 1.
Figure 2B:
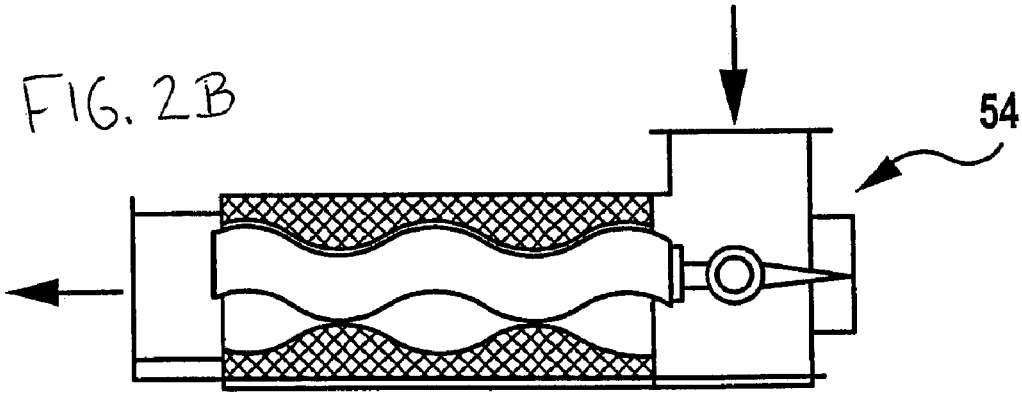
Figure 2C:
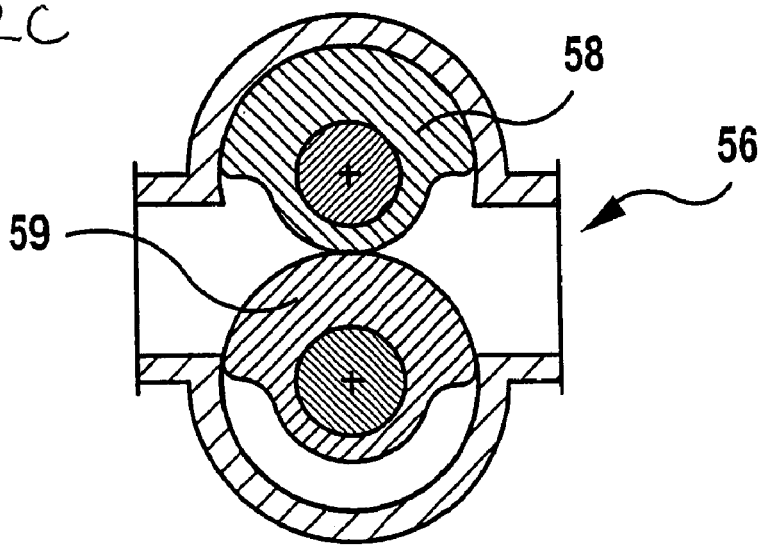

FIGS. 2A–2C show three alternative embodiments of a pumping mechanism that could be implemented instead of the magnetic pump 26 depicted in FIG. 1. FIG. 2A shows a gear pump 50 with two counter-rotating gears 52, 53 which is integrated in the feed line 24. A second alternative embodiment depicted in FIG. 2B uses an the eccentric screw 54 which is preferably flanged directly to the outlet in the bottom 22 of the container 12. The drive (not shown) can be arranged so as to form an extension of the horizontally oriented screw.

FIG. 2C shows a third embodiment implemented as a rotary pump 56, whereby two rotary pistons 58, 59 that rotate in the same direction force the processed metallic material through the supply line 24.

The illustrated pumping units are merely illustrative and those skilled in the art will appreciate that pumping arrangements other than those illustrated in FIGS. 2A–2C can be used, for example a centrifugal pump.

All the aforedescribed embodiments using mechanical pumps disadvantageously include moving mechanical parts located in the flow path of the processed metallic material that can wear out are and may require increased maintenance.

Figure 3:
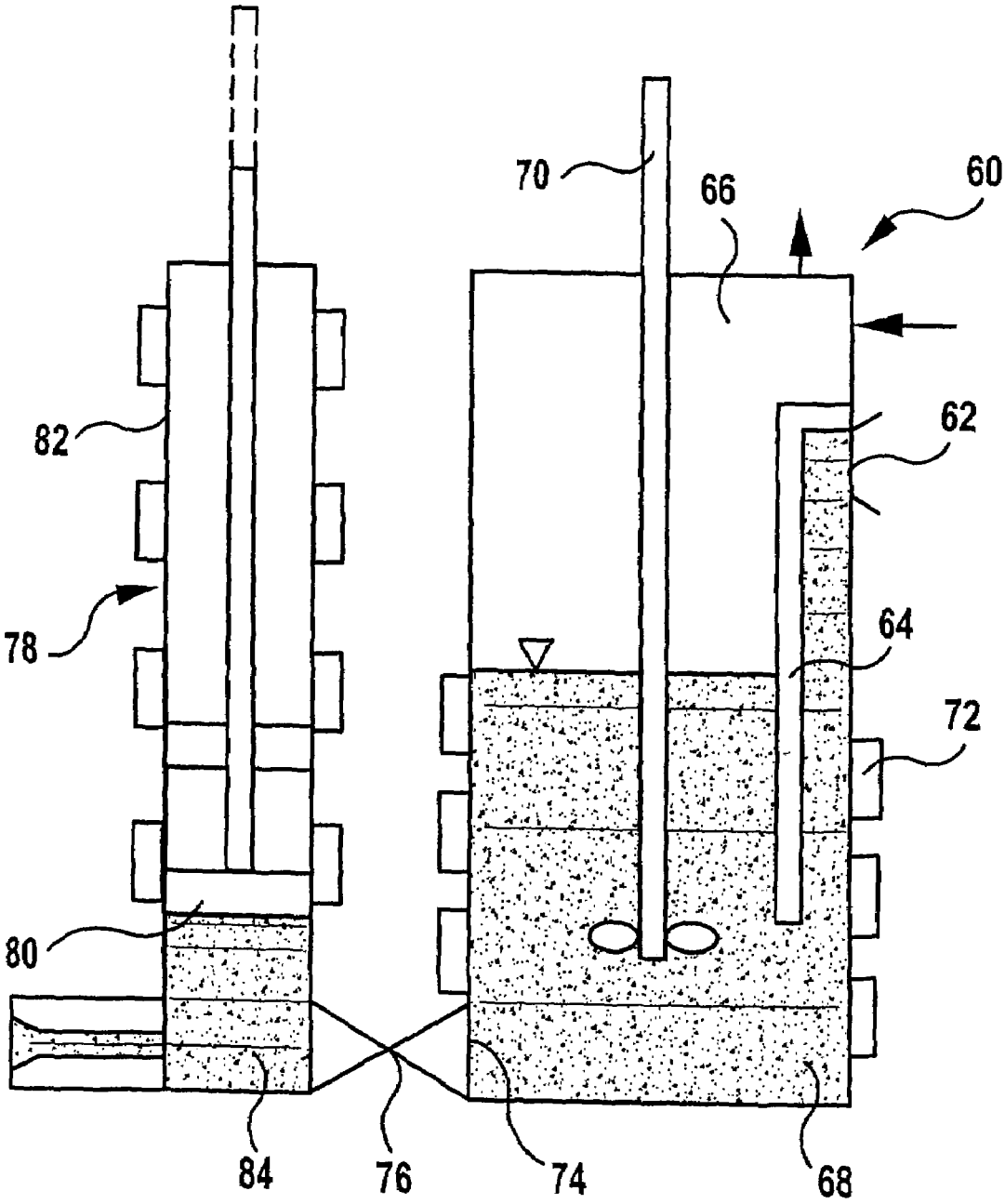
FIG. 3 shows an alternative embodiment of a storage container and an injection unit of the casting system of the invention depicted in FIG. 1.

FIG. 3 shows a modification of the storage container 26 with an immersed injection unit 36, whereby a separately formed storage container 60 is connected above an inlet 62 located above a maximum filled level of the container 60. Before the inlet 62, a bulkhead wall 64 extends below the minimal allowed filled level of the storage container 60, so that newly admitted metallic processed material can enter the volume of processed metallic material 68 without making contact with a gas volume 66 present in the storage container 60.

The storage container 60 is here depicted with a mechanical stirring device 70 which can be replaced, for example, with an electromagnetic and/or inductive stirring device.

The outer periphery of the storage container is heated by a heating device 70, so that the processed metallic material, which is kept on hand for the injection process, can be temperature-stabilized and/or conditioned. It will be understood that the storage container 60 can also be supplied at the bottom of the storage container 60, in a manner similar to that depicted in FIG. 1.

An outlet 74 followed by an interruptible connection line 76 to the injection unit 78 is arranged in the region of the bottom of the storage container 60. In the exemplary embodiment, the injection unit 78 is constructed as a separate unit from the storage container 60, which significantly facilitates the maintenance on the injection unit. The connection line 76 includes a shutoff device, as shown more particularly in FIG. 4.

The injection unit 78 includes an injection piston 80 which can move up and down inside an injection cylinder 82 in a vertical direction (see dotted line). This arrangement cyclically changes the volume 84 of processed metallic material in the injection cylinder. During the injection process, the connection line 76 and/or the shutoff device disposed in the connection line 76 is closed, which eliminates backpressure that may otherwise cause a backflow of processed metallic material into the volume 68 of the storage container 60.

Figure 4:
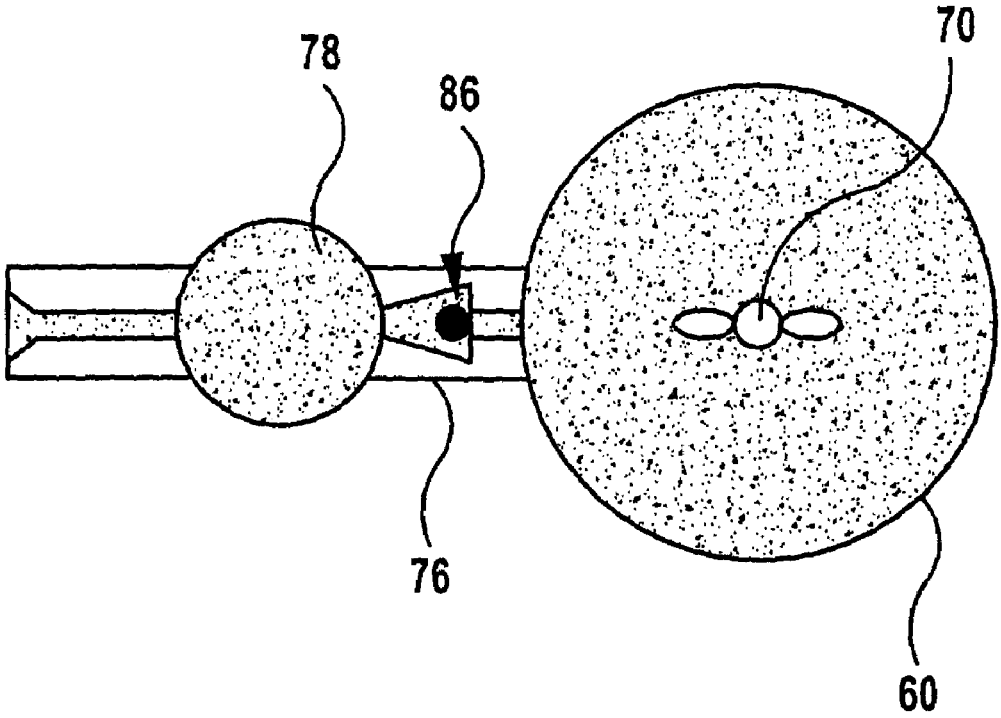
FIG. 4 is in a top view of a detail of the alternative embodiment according to FIG. 3.

In the embodiment depicted in FIG. 4, the connecting line 76 is closed off by a check valve 86.

Figure 5:
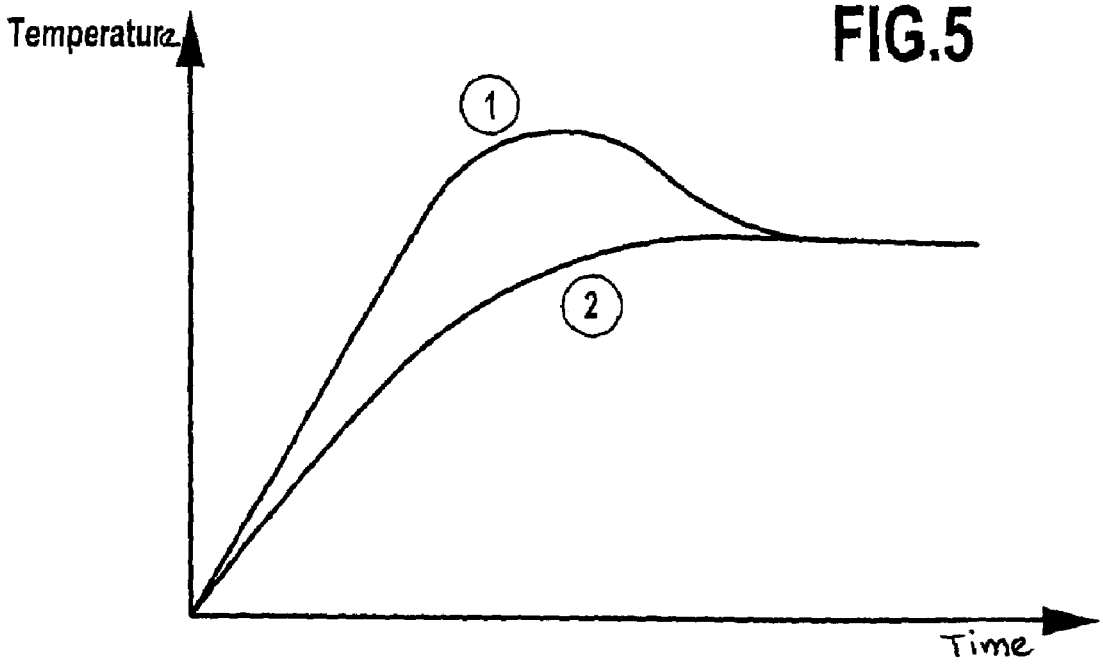
FIG. 5 shows a diagram with different temperature/time curves for the metallic material to be processed and the processed metallic material up to the time of injection.

FIG. 5 shows a temperature/time diagram with two different temperature curves (1) and (2). The temperature curve (1) exceeds the liquidus temperature, so that a subsequently produced component does not contain microstructure fractions of the original solid material. The casting apparatus of the invention implements this type of temperature control in a particularly simple and elegant manner. The temperature in the first container preferably reaches or exceeds the liquidus temperature of the metallic material. The storage container is used to lower the temperature of the processed metallic material to a value in the range between the solidus and liquidus temperature. When the process operates in this manner, no trace from the original microstructure of the starting material can be found in the finished component, so that a consistent microstructure can be achieved in the finished component.

In not quite as critical situations, the process can be controlled according to curve (2), which not only reduces the required heating energy, but also the corrosion of the various components of the apparatus. Moreover, the heating rates for the starting material can be lower and a lesser amount of dissolved gas may be incorporated in the processed metallic material. With the temperature control of curve (2), the processing temperature can be reached much more quickly than with the temperature control of curve (1) for the same heating rate.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A process for casting metallic materials, comprising the steps of:

processing a solid metallic starting material disposed in a first container by heating the material with an inductive heating device to a temperature above the solidus temperature of the metallic starting material;

transporting the processed metallic material to a storage container for entry into the storage container from below a fill level of processed metallic material in the storage container so as to prevent contact with a gas volume prevailing in the storage container above the fill level;

transporting the processed metallic material from the storage container to an injection unit; and transporting the processed metallic material from the injection unit to a casting tool.

2. The process of claim 1, further comprising the step of stirring the metallic material with a separate inductive device.

3. The process of claim 1, wherein the solid metallic starting material is heated above a liquidus temperature for obtaining a completely liquid phase.

4. The process of claim 1, wherein the solid metallic starting material is heated above the solidus temperature, but below a liquidus temperature so as to obtain a processed material containing both liquid and solid phases.

5. The process of claim 1, wherein the processed metallic material is sifted before being transported to the storage container.

6. The process of claim 1, wherein the processed material is transported from the first container to the storage container by an effective static pressure.

7. The process of claim 1, wherein the processed material is transported from the first container to the storage container by a magnetic pump.

8. The process of claim 1, wherein the processed material is transported from the first container to the storage container by a mechanical feed assembly selected from the group consisting of feed screws, gear pumps, eccentric screws, radial piston pumps, rotary pumps and centrifugal pumps.

9. The process of claim 1, wherein the processed metallic material is stirred in the storage container.

* * * * *